US011187470B2

(12) United States Patent
Retersdorf

(10) Patent No.: US 11,187,470 B2
(45) Date of Patent: Nov. 30, 2021

(54) PLATE FIN CROSSFLOW HEAT EXCHANGER

(71) Applicant: Hamilton Sundstrand Corporation, Charlotte, NC (US)

(72) Inventor: Alan Retersdorf, Avon, CT (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 55 days.

(21) Appl. No.: 16/529,248

(22) Filed: Aug. 1, 2019

(65) Prior Publication Data

US 2021/0033352 A1 Feb. 4, 2021

(51) Int. Cl.

| | |
|---|---|
| ***F28F 3/02*** | (2006.01) |
| ***F28D 7/16*** | (2006.01) |
| ***F28D 1/03*** | (2006.01) |
| ***F28F 9/02*** | (2006.01) |
| ***F28D 9/00*** | (2006.01) |
| ***F28D 9/02*** | (2006.01) |
| ***F28D 21/00*** | (2006.01) |
| ***B21D 53/02*** | (2006.01) |
| *F02B 29/04* | (2006.01) |

(52) U.S. Cl.

CPC ..... *F28F 3/02* (2013.01); *B21D 53/02* (2013.01); *F28D 1/0341* (2013.01); *F28D 7/1684* (2013.01); *F28D 9/0043* (2013.01); *F28D 9/0056* (2013.01); *F28D 9/0068* (2013.01); *F28D 9/02* (2013.01); *F28F 9/0268* (2013.01); *F02B 29/0425* (2013.01); *F28D 9/0062* (2013.01); *F28D 2021/0021* (2013.01); *F28F 3/025* (2013.01); *F28F 2210/02* (2013.01); *F28F 2230/00* (2013.01)

(58) Field of Classification Search

CPC .... F28F 3/025; F28F 2210/10; F28F 2230/00; F28F 9/0268; F28D 9/0062; F28D 9/02; F28D 2021/0021; F28D 9/0043; F28D 9/0056; F28D 9/0068; F28D 1/0341; F28D 7/1684; B64D 13/00; F02B 29/0425

See application file for complete search history.

(56) References Cited

U.S. PATENT DOCUMENTS 3,613,782 A * 10/1971 Mason ..... F28D 9/0068 165/166

4,616,695 A 10/1986 Takahashi et al.

(Continued)

FOREIGN PATENT DOCUMENTS

EP 3508806 A2 7/2019
FR 1516432 A 3/1968

(Continued)

OTHER PUBLICATIONS

Extended European Search Report for EP Application No. 19213736.2, dated Jun. 30, 2020, 8 pages.

*Primary Examiner* — Len Tran
*Assistant Examiner* — Jenna M Hopkins
(74) *Attorney, Agent, or Firm* — Kinney & Lange, P.A.

(57) ABSTRACT

A heat exchanger includes a body that includes an at least two opposing surfaces and the at least two opposing surfaces are a trapezoidal. The body of the heat exchanger also includes, an area of cross sectional flow channels through the body. The area of cross-sectional flow channels in a direction perpendicular to the bases of the trapezoid increase or decrease between the two bases.

15 Claims, 4 Drawing Sheets

(56) References Cited

U.S. PATENT DOCUMENTS

| | | | | |
|---|---|---|---|---|
| 9,593,647 | B2 * | 3/2017 | Demots | F28D 7/0041 |
| 2003/0226655 | A1 * | 12/2003 | Fitzpatrick | F28D 9/0062 165/166 |
| 2015/0276256 | A1 | 10/2015 | Erb et al. | |
| 2021/0033352 | A1 * | 2/2021 | Retersdorf | F28D 9/0068 |

FOREIGN PATENT DOCUMENTS

| | | | | |
|---|---|---|---|---|
| GN | 104613795 | A | 5/2015 | |
| JP | 6052596 | A | 3/1985 | |
| WO | WO2005/045345 | A2 | 5/2005 | |
| WO | WO2008/143318 | A1 | 11/2008 | |
| WO | WO-2020033013 | A2 * | 2/2020 | F28D 21/001 |

* cited by examiner

PLATE FIN CROSSFLOW HEAT EXCHANGER

BACKGROUND

The present disclosure relates to heat exchangers, and in particular to plate-fin crossflow heat exchangers.

Heat exchangers are often used to transfer heat between two fluids. For example, in aircraft environmental control systems, heat exchangers may be used to transfer heat between a relatively hot air source (e.g., bleed air from a gas turbine engine) and a relatively cool air source (e.g., ram air). Some heat exchangers, often referred to as plate-fin heat exchangers, include a plate-fin core having multiple heat transfer sheets arranged in layers to define air passages there between. Closure bars seal alternating inlets of hot air and cool air inlet sides of the core. Accordingly, hot air and cool air are directed through alternating passages to form alternating layers of hot and cool air within the core. Heat is transferred between the hot and cool air via the heat transfer sheets that separate the layers. In addition, to facilitate heat transfer between the layers, each of the passages can include heat transfer fins, often formed of a material with high thermal conductivity (e.g., aluminum), that are oriented in the direction of the flow within the passage. The heat transfer fins increase turbulence and a surface area that is exposed to the airflow, thereby enhancing heat transfer between the layers.

Due to existing structures and manufacturing techniques, known plate-fin heat exchangers have a rectangular axial cross section. In some applications, such as aircraft environmental control systems, the plate-fin heat exchangers are arranged around a central axis, or are arranged in non-square compartment and spaces. As a result of the rectangular cross-section of the plate-fin heat exchangers, gaps occur between adjacent plate-fin heat exchangers and between a non-square housing and the plate-fin heat exchangers. These gaps create dead space next to the plate-fin heat exchangers that cannot be used by the plate-fin heat exchangers.

SUMMARY

In one embodiment, a heat exchanger includes a body that includes an at least two opposing surfaces and the at least two opposing surfaces are a trapezoidal. The body of the heat exchanger also includes, an area of cross sectional flow channels through the body. The area of cross-sectional flow channels in a direction perpendicular to the bases of the trapezoid increase or decrease between the two bases.

In another embodiment, a heat exchanger includes a first side of the heat exchanger opposite a second side of the heat exchanger. The heat exchanger also includes a third side of the heat exchanger that extends from the first side of the heat exchanger to the second side of the heat exchanger and also extends in the lengthwise dimension. The heat exchanger also includes a fourth side of the heat exchanger that extends from the first side of the heat exchanger to the second side of the heat exchanger and also extends in the lengthwise dimension. The fourth side of the heat exchanger is longer in the lengthwise dimension than the third side of the heat exchanger and is also parallel to the third side of the heat exchanger. The heat exchanger also includes a fifth side of the heat exchanger that extends from the first side of the heat exchanger to the second side of the heat exchanger and also extends from the third side of the heat exchanger to the fourth side of the heat exchanger. The heat exchanger also includes a sixth side of the heat exchanger that extends from the first side of the heat exchanger to the second side of the heat exchanger and also extends from the third side of the heat exchanger to the fourth side of the heat exchanger. The heat exchanger also includes a first layer that has a first plurality of passages. Each passage of the first plurality of passages extends from the fifth side of the heat exchanger to the sixth side of the heat exchanger. The heat exchanger also includes a second layer that has a second plurality of passages. Each passage of the second plurality of passages extends from the third side of the heat exchanger to the fourth side of the heat exchanger. The second layer has a first section, and the second plurality of passages extends in a first direction in the first section. The second layer also has a second section that is adjacent to the first section. The second section has three edges that form a triangle. One of the three edges of the second section is at the sixth side of the heat exchanger and extends along the entire length of the sixth side of the heat exchanger. The second plurality of passages extends in a second direction in the second section. The first direction is angled relative to the second direction.

In another embodiment, a method for manufacturing a heat exchanger includes cutting a first partition sheet, a second partition sheet, and a third partition sheet so that the first partition sheet, the second partition sheet, and the third partition sheet each have a trapezoidal profile with a first side of the heat exchanger parallel to a second side of the heat exchanger and shorter than the second side, a third side extending between the first side of the heat exchanger and the second side of the heat exchanger, and a fourth side of the heat exchanger extending between the first side of the heat exchanger and the second side of the heat exchanger. A first plurality of fins is positioned between the first partition sheet and the second partition sheet to form the first plurality of passages. Each passage of the first plurality of passages extends from the third side of the heat exchanger to the fourth side of the heat exchanger of the first partition sheet and the second partition sheet. A second plurality of fins is positioned between the second partition sheet and the third partition sheet. The second plurality of fins extends in a first direction. A third plurality of fins is positioned between the second partition sheet and the third partition sheet and adjacent to the second plurality of fins. The second plurality of fins extends in a second direction angled relative to the first direction. The second plurality of fins and the third plurality of fins together form a second plurality of passages that extends from the first side of the heat exchanger to the second side of the heat exchanger of the second partition sheet and the third partition sheet.

Persons of ordinary skill in the art will recognize that other aspects and embodiments are possible in view of the entirety of the present disclosure, including the accompanying figures.

Figure 1:
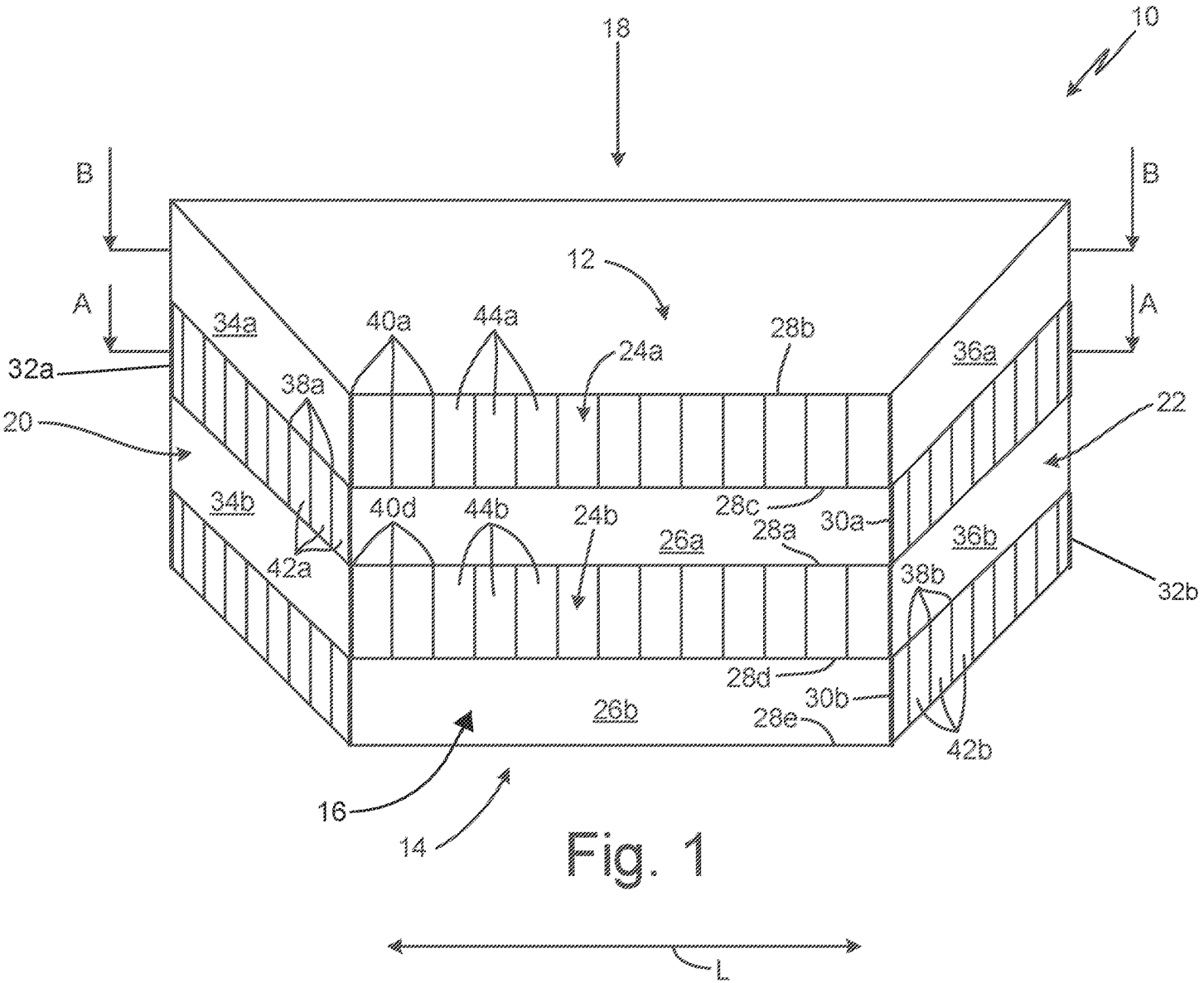
FIG. 1 is a perspective view of a heat exchanger.

While the above-identified drawing figures set forth one or more embodiments, other embodiments are also contemplated. It should be understood that numerous other modifications and embodiments can be devised by those skilled in the art, which fall within the scope and spirit of the principles of the claims. The figures may not be drawn to scale, and applications and embodiments may include features and components not specifically shown in the drawings. Like reference numerals identify similar structural elements.

DETAILED DESCRIPTION

The disclosure relates to a heat exchanger with multiple layers. Each layer of the heat exchanger has a trapezoidal profile. The trapezoidal profile of the heat exchanger allows the heat exchanger to better fill and utilize non-rectangular spaces. The disclosure also relates to a method for manufacturing the trapezoidal heat exchanger. The trapezoidal heat exchanger is described below with reference to FIGS. 1-4.

FIG. 1 is a perspective view of heat exchanger 10. As shown in FIG. 1, heat exchanger 10 includes top side 12, bottom side 14, first side 16, second side 18, third side 20, fourth side 22, cold layer 24*a*, cold layer 24*b*, hot layer 26*a*, and hot layer 26*b*. Cold layer 24*a* includes parting sheet 28*b*, parting sheet 28*c*, closure bar 34*a*, closure bar 36*a*, plurality of fins 40*a*, and plurality of passages 44*a*. Cold layer 24*b* includes parting sheet 28*a*, parting sheet 28*d*, closure bar 34*b*, closure bar 36*b*, plurality of fins 40*d*, and plurality of passages 44*b*. Hot layer 26*a* includes parting sheet 28*a*, parting sheet 28*c*, closure bar 30*a*, closure bar 32*a*, plurality of fins 38*a*, and plurality of passages 42*a*. Hot layer 26*b* includes parting sheet 28*d*, parting sheet 28*e*, closure bar 30*b*, closure bar 32*b*, plurality of fins 38*b*, and plurality of passages 42*b*.

Top side 12 of heat exchanger 10 is opposite bottom side 14. First side 16 extends from top side 12 to bottom side 14, and first side 16 extends in a lengthwise dimension (See FIG. 1). Second side 18 extends from top side 12 to bottom side 14. Second side 18 is longer in the lengthwise dimension L than first side 16. Also in the embodiment of FIG. 1, second side 18 is parallel to first side 16. Third side 20 extends from top side 12 to bottom side 14 and extends from first side 16 to second side 18. Fourth side 22 extends from top side 12 to bottom side 14 and extends from first side 16 to second side 18. Together, top side 12, bottom side 14, first side 16, second side 18, third side 20, and fourth side 22 form a trapezoid.

Cold layer 24*a* has fins 40*a* and passages 44*a* that all extend from first side 16 to second side 18. Cold layer 24*a* has a plurality of sections that are discussed in FIGS. 3 and 4 below. Similar to cold layer 24*a*, cold layer 24*b* has fins 40*d* and passages 44*b* that extend from first side 16 to second side 18. Hot layer 26*a* has fins 38*a* and passages 42*a* that extend from third side 20 to fourth side 22. Similar to hot layer 26*a*, hot layer 26*b* has fins 38*b* and passages 42*b* that extend from third side 20 to fourth side 22. Cold layer 24*a* and hot layer 26*a* are both contiguous to parting sheet 28*c*. Cold layer 24*b* and hot layer 26*b* are both contiguous to parting sheet 28*d*.

During operation of heat exchanger 10, cold air flows in through first side 14 and into passages 44*a* and passages 44*b* and exits out of second side 18. Fins 38*a* and fins 38*b* increase the surface area in passages 42*a* and passages 42*b* respectively, which results in increased heat transfer capabilities for hot layer 26*a* and hot layer 26*b*. Hot air flows in through third side 20 into passages 42*a* and passages 42*b* and out fourth side 22. Fins 40*a* and fins 40*a* increase the surface area in passages 44*a* and passages 44*b* respectively, which results in increased heat transfer capabilities for hot layer 26*a* and hot layer 26*b*.

Figure 2:
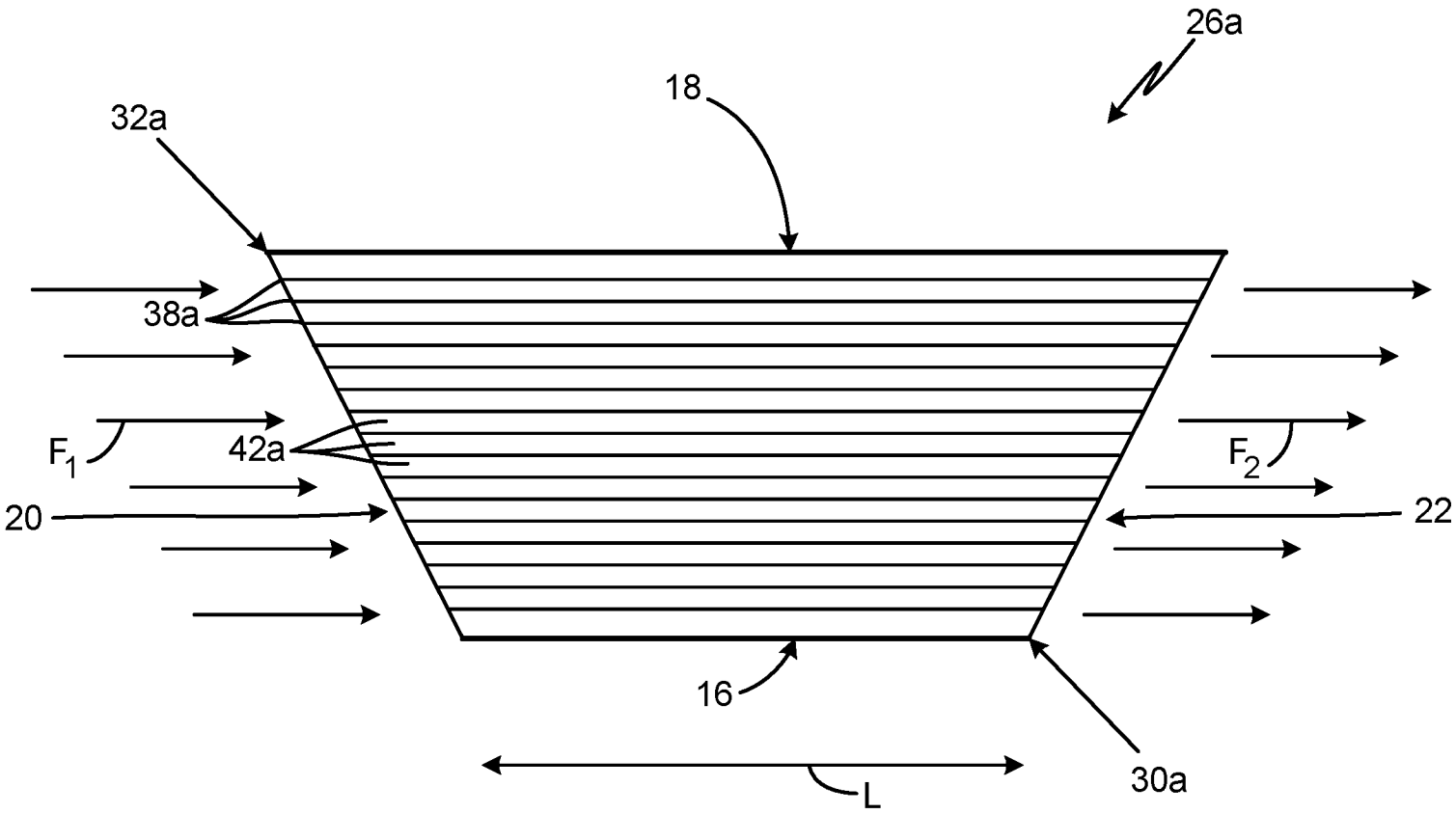
FIG. 2 is a cross-sectional view of the heat exchanger taken along line A-A in FIG. 1, showing a first layer of the heat exchanger.

FIG. 2 is a cross-sectional view of heat exchanger 10 taken along line A-A from FIG. 1, showing hot layer 26*a*. Hot layer 26*a* includes first side 16, second side 18, third side 20, fourth side 22, closure bar 30*a*, closure bar 32*a*, plurality of fins 38*a*, and plurality of passages 42*a*. Closure bar 30*a* has the same lengthwise dimension as first side 16. Closure bar 32*a* and second side 18 have the same length in the lengthwise dimension L, and are both longer than first side 16 and closure bar 30*a*. Closure bar 30*a* and closure bar 32*a* are parallel to one another. Fins 38*a* and passages 42*a* start at third side 20 and extend to fourth side 22. Inlet hot air flow F1 and outlet hot air flow F2 are also shown in FIG. 2.

Inlet hot air flow F1 enters passages 42*a* of hot layer 26*a* at third side 20, and exits as outlet hot air flow F2 at fourth side 22. The temperature of inlet hot air flow F1 is higher than the temperature of outlet hot air flow F2. As shown in FIG. 2, passages 42*a* extend straight in the lengthwise dimension L from third side 20 to fourth side 22. In other embodiments, passages 42*a* and fins 38*a* can zig-zag in a repeating pattern as passages 42*a* and fins 38*a* extend from third side 20 to fourth side 22.

Figure 3:
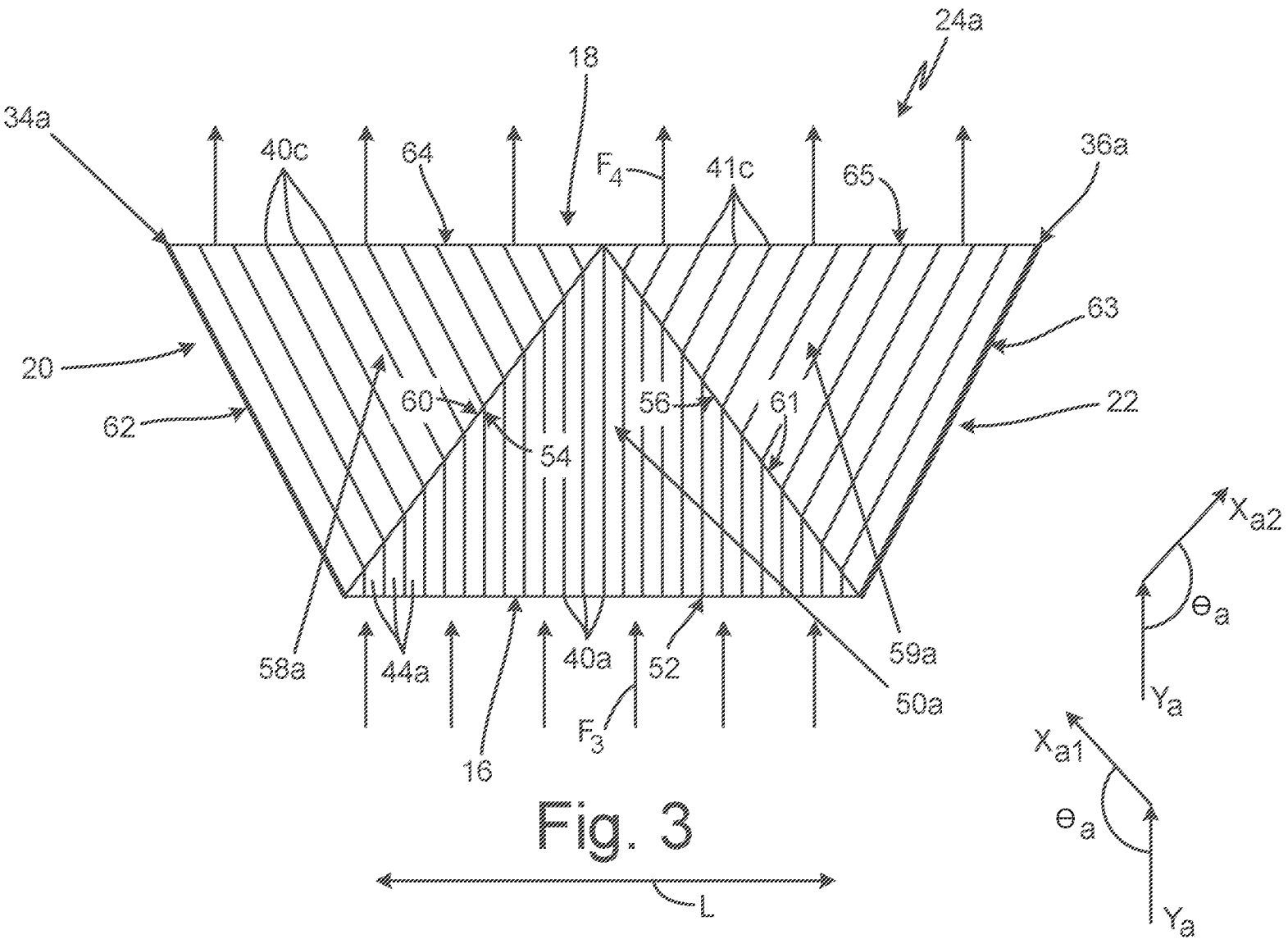
FIG. 3 is a cross-sectional view of the heat exchanger taken along line B-B in FIG. 1, showing a second layer of the heat exchanger.

FIG. 3 is a cross-sectional view of cold layer 24*a* taken along line B-B from FIG. 1. Cold layer 24*a* includes first side 16, second side 18, third side 20, fourth side 22, closure bar 34*a*, closure bar 36*a*, plurality of passages 44*a*, first section 50*a*, second section 58*a*, and third section 59*a*. First section 50*a* includes plurality of fins 40*a*, base edge 52, second edge 54, and third edge 56. Second section 58*a* includes plurality of fins 40*c*, base edge 60, second edge 62, and third edge 64. Third section 59*a* includes plurality of fins 41*c*, base edge 61, second edge 63, and third edge 65. First direction ya, second direction xa1, third direction xa2, angle ⊖a, inlet cold flow F3, and outlet cold flow F4 are also shown in FIG. 3.

Together, first section 50*a*, second section 58*c*, and third section 59*a* form cold layer 24*a*. In the embodiment of FIG. 3, first section 50*a* is triangular, with base edge 52, second edge 54, and third edge 56 forming a triangle extending from first side 16 to second side 18. Base edge 52 has the same length as first side 16 in the lengthwise dimension L. Fins 40*a* extend from base edge 52 toward second side 18 in first direction ya.

Second section 58*a* is also triangular with base edge 60, second edge 62, and third edge 64 forming a triangle. Base edge 60 of second section 58*a* abuts second edge 54 of first section 50*a*. Second edge 62 of second section 58*a* abuts closure bar 34*a* and extends from first side 16 to second side 18. Third edge 64 of second section 58*a* extends along second side 18 from closure bar 34*a* to base edge 60. Fins 40*c* extend in second section 58*a* from base edge 60 to third edge 64 in direction xa1. Fins 40*c* can be parallel to second edge 62 of second section 58*a*.

Third section 59*a* is also triangular with base edge 61, second edge 63, and third edge 65 forming a triangle. Base edge 61 of third section 59*a* abuts third edge 56 of first section 50*a*. Second edge 63 abuts closure bar 36*a* and extends from first side 16 to second side 18. Third edge 65 of third section 59*a* extends along second side 18 from closure bar 36*a* to base edge 61 of third section 59*a*. Fins 41*c* extend in third section 59*a* from base edge 61 to third edge 65 in direction xa2. Fins 41*c* can be parallel to second edge 63 of third section 59*a*. Direction ya and directions xa1 and xa2 are related by angle ⊖a.

Together, fins 40*a*, 40*c*, and 41*c* form passages 44*a* in cold layer 24*a*. Passages 44*a* extend in direction ya as passages 44*a* extend in first section 50*a*. In second section 58*a*, passages 44*a* extend in direction xa1, which is angled relative direction ya by angle ⊖a. In third section 59*a*, passages 44*a* extend in direction xa2, which is angled relative direction ya by angle ⊖a. Thus, as inlet cold air flow F3 enters passages 44*a* at first side 16 in first section 50*a*, inlet cold air flow F3 first travels in direction ya before turning to directions xa1 and xa2 as the cold air flow enters second section 58*a* and third section 59*a*. After traversing second section 58*a* and third section 59*a*, outlet cold air flow F4 exits passages 44*a* at second side 18. The temperature of inlet cold air flow F3 is lower than the temperature of outlet cold airflow F4.

In manufacturing heat exchanger 10 of FIGS. 1-3, cold layer 24*a*, cold layer 24*b*, hot layer 26*a*, and hot layer 26*b* are stacked and brazed together.

Hot layer 26*a* is manufactured by laying closure bar 30*a* and closure bar 32*a* on top of parting sheet 28*a* so that closure bar 30*a* is along first side 16 and closure bar 32*a* is along second side 18. Fins 38*a* are positioned so that passages 42*a* extend from third side 20 to fourth side 22. Parting sheet 28*c* is placed on top of closure bar 30*a* and closure bar 32*a* to complete hot layer 26*a*.

Cold layer 24*a* is manufactured by placing closure bar 34*a* and closure bar 36*a* on top of parting sheet 28*c* with closure bar 34*a* on third side 20 and closure bar 36*a* on fourth side 22 extending from first side 16 to second side 18. First section 50*a* is positioned so that base edge 52 abuts first side 16 and fins 40*a* extend from first side 16 toward second side 18 in direction ya. Second section 58*a* is positioned so that base edge 60 extends from third edge 54 to closure bar 34*a* and fins 40*c* extend in direction xa1. Second edge 62 is positioned so that second edge 62 abuts closure bar 34*a*. Third section 59*a* is positioned so that base edge 61 abuts third edge 56 of first section 50*a*, third edge 63 abuts closure bar 36*a*, and fins 41*c* extend in direction xa2. Parting sheet 28*b* is placed on top of closure bar 34*a* and closure bar 36*a* to complete cold layer 24*a*.

Figure 4:
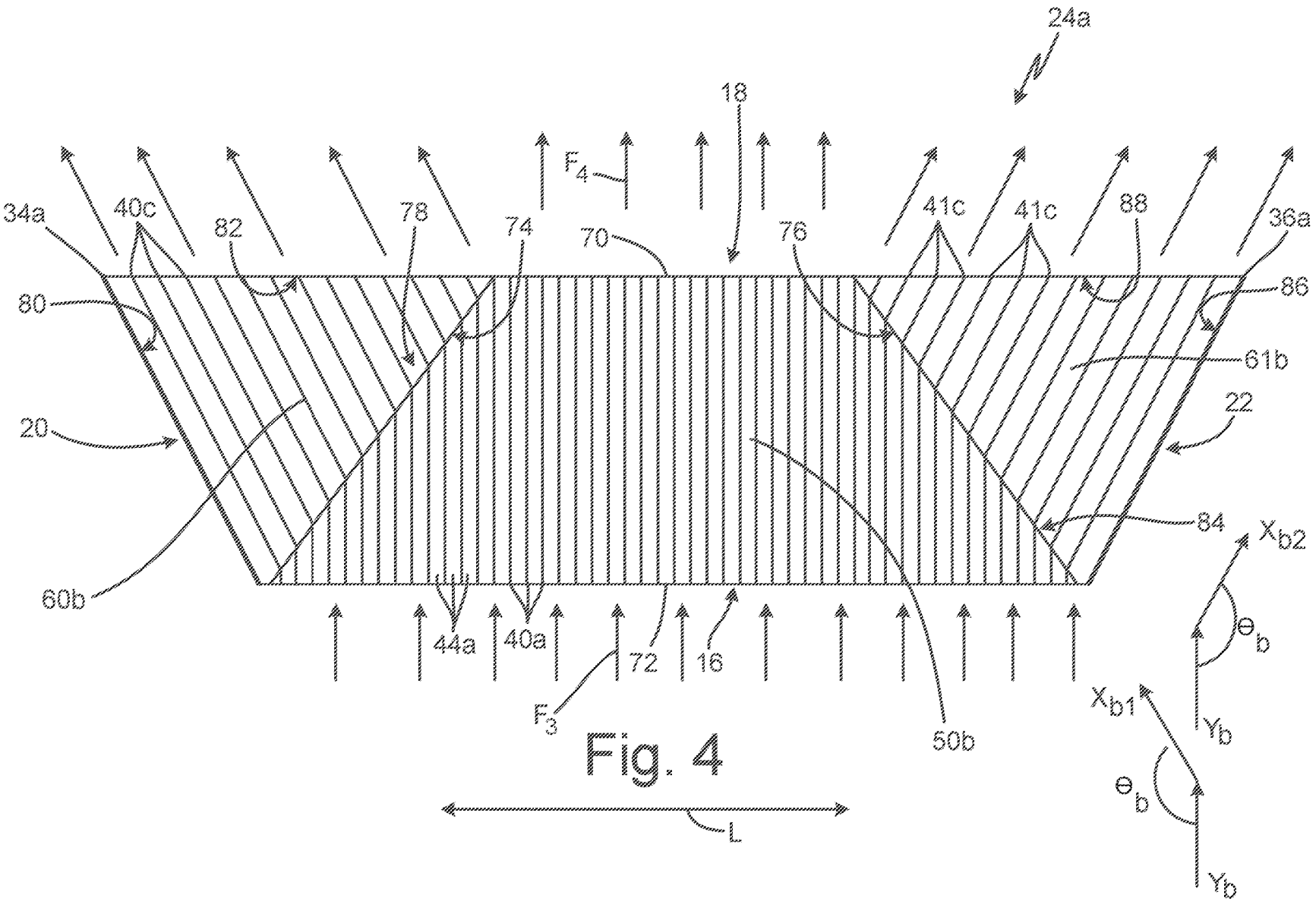
FIG. 4 is a cross-sectional view of another embodiment of the heat exchanger taken along line B-B in FIG. 1, showing a second layer of the heat exchanger.

FIG. 4 is a cross-sectional view of another embodiment of cold layer 24*a* for heat exchanger 10. Cold layer 24*a* includes first side 16, second side 18, third side 20, fourth side 22, closure bar 34*a*, closure bar 36*a*, plurality of passages 44*a*, first section 50*b*, second section 60*b*, and third section 61*b*. As shown in FIG. 4, first section 50*b* includes base edge 70, second edge 72, third edge 74, fourth edge 76, and plurality of fins 40*a*. Second section 60*b* includes base edge 78, second edge 80, third edge 82, and plurality of fins 40*c*. Third section 61*b* includes base edge 84, second edge 86, third edge 88, and plurality of fins 41*c*. Direction yb, direction xb1, direction xb2, angle ⊖b, inlet cold flow F3, and outlet cold flow F4 are also shown in FIG. 4.

First section 50*b*, second section 60*b*, and third section 61*b* together form passages 44*a* in cold layer 24*a*. First section 50*b* is trapezoidal and base edge 70, second edge 72, third edge 74, and fourth edge 76 form a perimeter of first section 50*b*. Base edge 70 extends along second side 18 and is parallel to second edge 72. Second edge 72 has the same length in the lengthwise dimension L as first side 16. Base edge 70 is shorter in the lengthwise dimension L than second edge 72. Third edge 74 and fourth edge 76 extend from base edge 70 to second edge 72. Fins 40*a* extend from second edge 72 toward base edge 70 in direction yb.

Second section 60*b* is triangular with base edge 78, second edge 80, and third edge 82 forming a perimeter of second section 60*b*. Base edge 78 abuts third edge 74 and extends from first side 16 to second side 18. Second edge 80 abuts closure bar 34*a* and extends from first side 16 to second side 18. Third edge 82 extends from closure bar 34*a* to base edge 78 along second side 18. Fins 40*c* start at base edge 78 and extend in direction xb1.

Third section 61*b* is also triangular with base edge 84, second edge 86, and third edge 88 forming a perimeter of third section 61*b*. Base edge 84 abuts fourth edge 76 and extends from first side 16 to second side 18. Second edge 86 abuts closure bar 36*a* and extends from first side 16 to second side 18. Third edge 88 extends from closure bar 36*a* to base edge 84 along second side 18. Fins 41*c* start at base edge 84 and run in direction xb2. Direction yb and directions xb1 and xb2 are related by angle ⊖b.

Cold layer 24*a* is manufactured by placing closure bar 34*a* and closure bar 36*a* on top of parting sheet 28*c* with closure bar 34*a* on third side 20 and closure bar 36*a* on fourth side 22 extending from first side 16 to second side 18. First section 50*b* is positioned so that base edge 72 abuts first side 16 and fins 40*a* and passages 44*a* extend from first side 16 to second side 18 in direction yb. Second section 60*b* is positioned so that base edge 78 extends from third edge 74 to closure bar 34*a* and fins 40*c* extend in direction xb1. Second edge 80 is positioned so that second edge 80 abuts closure bar 34*a*. Third section 61*b* is positioned so that base edge 84 abuts fourth edge 76, second edge 86 abuts closure bar 36*a*, and fins 41*c* extend in direction xb2. Parting sheet 28*b* is placed on top of closure bar 34*a* and closure bar 36*a* to complete the embodiment of cold layer 24*a* shown in FIG. 4.

The process of stacking cold and hot layers can result in a plurality of hot layers and a plurality of cold layers stacked in alternating order as highlighted above. Once stacks are made, they will be brazed together to form heat exchanger 10.

The following are non-exclusive descriptions of possible embodiments of the present invention.

In one embodiment, a heat exchanger includes a body that includes an at least two opposing surfaces and the at least two opposing surfaces are a trapezoidal. The body of the heat exchanger also includes, an area of cross sectional flow channels through the body. The area of cross-sectional flow channels in a direction perpendicular to the bases of the trapezoid increase or decrease between the two bases.

The heat exchanger of the preceding paragraph can optionally include, additionally and/or alternatively, any one or more of the following features, configurations and/or additional components:

a heat exchanger includes a first side of the heat exchanger opposite a second side of the heat exchanger. The heat exchanger also includes a third side of the heat exchanger that extends from the first side of the heat exchanger to the second side of the heat exchanger and extends in the lengthwise dimension. The heat exchanger also includes a fourth side of the heat exchanger extending from the first side of the heat exchanger to the second side of the heat exchanger. The fourth side of the heat exchanger is longer in a lengthwise dimension than the third side of the heat exchanger and is parallel to the third side. The heat exchanger also includes a fifth side of the heat exchanger that extends from the first side of the heat exchanger to the second side of the heat exchanger. The fifth side of the heat exchanger extends from the third side of the heat exchanger to the fourth side of the heat exchanger. The heat exchanger also includes a sixth side of the heat exchanger that extends from the first side of the heat exchanger to the second side of the heat exchanger. The sixth side of the heat exchanger extends from the third side of the heat exchanger to the fourth side of the heat exchanger. The heat exchanger also includes a first layer that has a first plurality of passages. Each passage of the first plurality of passages extends from the fifth side of the heat exchanger to the sixth side of the heat exchanger. The heat exchanger also includes a second layer that has a second plurality of passages. Each passage of the second plurality of passages extends from the third side of the heat exchanger to the fourth side of the heat exchanger. The second layer has a first section where the second plurality of passages extends in a first direction on the first section. The second layer has a second section that has a second plurality of passages that extends in the second direction on the second section. The first direction is angled relative to the second direction.

a first parting sheet that forms the top of the first layer; a second partition sheet that forms a bottom of the second layer; and a third partition sheet that is between the first layer and the second layer;

a first closure bar at the first side, between the first partition sheet and the third partition sheet, that extends the full length of the third side; a second closure bar at the fourth side, between the first partition sheet and the third partition sheet, that extends the full length of the fourth side; a third closure bar at the fifth side, between the third partition sheet and the second partition sheet, that extends the full length of fifth side; and a fourth closure bar on the sixth side, that is between the third parting sheet and the second parting sheet, and extends the full length of the sixth side;

a first section of the heat exchanger, with a triangular profile, with a base and two sides, wherein the base edge of the first section is on the third side and extends along an entire length of the third side;

a first section of the heat exchanger, with a trapezoidal profile, with a base and three sides, wherein the base edge of the first section is on the third side and extends along an entire length of the third side;

a second section of the heat exchanger, with triangular profile with three side edges, wherein one of the side edges of the second section is on the sixth side and extends an entire length of the sixth side;

a first plurality of passages in the first layer has an inlet on the fifth side and an outlet on the sixth side, and each passage of the second plurality of passages in the second layer comprises an inlet on the third side and an outlet on the fourth side;

a first plurality of passages in the first layer has an inlet on the sixth side and an outlet on the fifth side, and each passage of the second plurality of passages in the second layer comprises an inlet on the fourth side and an outlet on the fifth side; and/or a second plurality of passages in the second section of the second layer that is parallel to the sixth side, and a second plurality of passages in the first section is orthogonal to the third side.

In another embodiment, a heat exchanger includes a first side of the heat exchanger opposite a second side of the heat exchanger. The heat exchanger also includes a third side of the heat exchanger that extends from the first side of the heat exchanger to the second side of the heat exchanger and also extends in the lengthwise dimension. The heat exchanger also includes a fourth side of the heat exchanger that extends from the first side of the heat exchanger to the second side of the heat exchanger and also extends in the lengthwise dimension. The fourth side of the heat exchanger is longer in the lengthwise dimension than the third side of the heat exchanger and is also parallel to the third side of the heat exchanger. The heat exchanger also includes a fifth side of the heat exchanger that extends from the first side of the heat exchanger to the second side of the heat exchanger and also extends from the third side of the heat exchanger to the fourth side of the heat exchanger. The heat exchanger also includes a sixth side of the heat exchanger that extends from the first side of the heat exchanger to the second side of the heat exchanger and also extends from the third side of the heat exchanger to the fourth side of the heat exchanger. The heat exchanger also includes a first layer that has a first plurality of passages. Each passage of the first plurality of passages extends from the fifth side of the heat exchanger to the sixth side of the heat exchanger. The heat exchanger also includes a second layer that has a second plurality of passages. Each passage of the second plurality of passages extends from the third side of the heat exchanger to the fourth side of the heat exchanger. The second layer has a first section, and the second plurality of passages extends in a first direction in the first section. The second layer also has a second section that is adjacent to the first section. The second section has three edges that form a triangle. One of the three edges of the second section is at the sixth side of the heat exchanger and extends along the entire length of the sixth side of the heat exchanger. The second plurality of passages extends in a second direction in the second section. The first direction is angled relative to the second direction.

The heat exchanger of the preceding paragraph can optionally include, additionally and/or alternatively, any one or more of the following features, configurations and/or additional components:

a first section that comprises a first plurality of fins extending in the first section, and the section comprises a second plurality of fins extending in the second direction, and the first plurality of fins and the second plurality of fins form the second plurality of passages.

a first partition sheet that forms the top of the first layer; a second partition sheet that forms the bottom of the second layer; a third partition sheet that is between the first layer and the second layer; a first closure bar at the third side, between the first partition sheet and the third partition sheet, extending the entire length of the third side; a second closure bar at the fourth side, between the first partition sheet and the third partition sheet, extending a full length of the fourth side; a third closure bar at the fifth side, between the third partition sheet and the second partition sheet, that extends a full length of the fifth side; a fourth closure bar at the sixth side, between the third partition sheet and the second partition sheet, that extends a full length of the sixth side; the first plurality of fins and second plurality of fins are between the third partition sheet and the second partition sheet; and/or the first plurality of fins and the second plurality of fins are between the third partition sheet and the second partition sheet;

a first section that is a trapezoid and extends from the third side to the fourth side and comprises a base edge disposed on the fourth side extending an entire length of the third side;

a first section that is triangular with a base edge and two sides, wherein the base edge of the first section is on the third side and extends along an entire length of the third side;

the first layer comprises an inlet on the fifth side and an outlet on the sixth side, wherein the second layer comprises an inlet on the third side and an outlet on the fourth side;

the first layer comprises an inlet on the sixth side and an outlet on the fifth side, wherein the second layer comprises an inlet on the fourth side and an outlet on the third side; and/or the plurality of passages in the second section of the second layer are parallel to the sixth side and the second plurality of passages in the first section are orthogonal to the third side and the fourth side.

In another embodiment, a method for manufacturing a heat exchanger includes cutting a first partition sheet, a second partition sheet, and a third partition sheet so that the first partition sheet, the second partition sheet, and the third partition sheet each have a trapezoidal profile with a first side of the heat exchanger parallel to a second side of the heat exchanger and shorter than the second side, a third side extending between the first side of the heat exchanger and the second side of the heat exchanger, and a fourth side of the heat exchanger extending between the first side of the heat exchanger and the second side of the heat exchanger. A first plurality of fins is positioned between the first partition sheet and the second partition sheet to form the first plurality of passages. Each passage of the first plurality of passages extends from the third side of the heat exchanger to the fourth side of the heat exchanger of the first partition sheet and the second partition sheet. A second plurality of fins is positioned between the second partition sheet and the third partition sheet. The second plurality of fins extends in a first direction. A third plurality of fins is positioned between the second partition sheet and the third partition sheet and adjacent to the second plurality of fins. The second plurality of fins extends in a second direction angled relative to the first direction. The second plurality of fins and the third plurality of fins together form a second plurality of passages that extends from the first side of the heat exchanger to the second side of the heat exchanger of the second partition sheet and the third partition sheet.

The method of the preceding paragraph can optionally include, additionally and/or alternatively, any one or more of the following features, configurations and/or additional components:

brazing the first partition sheet, the first plurality of fins, the second partition sheet, the second plurality of fins, the third plurality of fins, and the third partition sheet together;

positioning a first closure bar between the first partition sheet and the second partition sheet at the first side of the first partition sheet and the second partition sheet; positioning a second closure bar between the first partition sheet and the second partition sheet at the second side of the first partition sheet and the second partition sheet; positioning a third closure bar between the second partition sheet and the third partition sheet at the third side of the second partition sheet and the third partition sheet; and positioning the fourth closure bar between the second partition sheet and the third partition sheet at the fourth side of the second partition sheet and the third partition sheet;

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A heat exchanger comprising:

a first side of the heat exchanger opposite a second side of the heat exchanger;

a third side of the heat exchanger extending from the first side of the heat exchanger to the second side of the heat exchanger, and extending in a lengthwise dimension;

a fourth side of the heat exchanger extending from the first side of the heat exchanger to the second side of the heat exchanger, and extending in the lengthwise dimension, wherein the fourth side of the heat exchanger is longer in the lengthwise dimension than the third side of the heat exchanger;

a fifth side of the heat exchanger extending from the first side of the heat exchanger to the second side of the heat exchanger, wherein the fifth side of the heat exchanger extends from the third side of the heat exchanger to the fourth side of the heat exchanger;

a sixth side of the heat exchanger extending from the first side of the heat exchanger to the second side of the heat exchanger, wherein the sixth side of the heat exchanger extends from the third side of the heat exchanger to the fourth side of the heat exchanger, wherein the fourth side of the heat exchanger extends in the lengthwise dimension parallel to the third side of the heat exchanger from the fifth side to the sixth side;

a first layer comprising a first plurality of passages, wherein each passage of the first plurality of passages extends from the fifth side of the heat exchanger to the sixth side of the heat exchanger; and a second layer comprising:

a second plurality of passages, wherein each passage of the second plurality of passages extends from the third side of the heat exchanger to the fourth side of the heat exchanger;

a first second, wherein the second plurality of passages extend in a first direction in the first section;

a second section, wherein the second plurality of passages extend in a second direction in the second section, and wherein the first direction is angled relative to the second direction; and a third section, wherein the second plurality of passages extend in a third direction in the third section, wherein the third direction is angled relative to the first direction and the second direction, wherein the first section comprises a base edge on the third side that extends along an entire length of the third side, wherein the second section is triangular with three side edges, wherein one of the three side edges of the second section is on the sixth side and extends along an entire length of the sixth side, and wherein another of the three side edges of the second section is on the fourth side, wherein the third section is triangular with three side edges, wherein one of the three side edges of the third section is on the fifth side and extends along an entire length of the fifth side, and wherein another of the three side edges of the third section is on the fourth side, and wherein the second plurality of passages in the second section of the second layer is parallel to the sixth side, and the second plurality of passages in the first section are orthogonal to the third side.

2. The heat exchanger of claim 1, further comprising:

a first partition sheet, wherein the first partition sheet forms a top of the first layer;

a second partition sheet, wherein the second partition forms a bottom of the second layer; and a third partition sheet, wherein the third partition sheet is between the first layer and the second layer.

3. The heat exchanger of claim 2, further comprising:

a first closure bar at the third side and extending a full length of the third side, wherein the first closure bar is between the first partition sheet and the third partition sheet;

a second closure bar at the fourth side and extending a full length of the fourth side, wherein the second closure bar is between the first partition sheet and the third partition sheet;

a third closure bar at the fifth side and extending a full length of the fifth side, wherein the third closure bar is between the third partition sheet and the second partition sheet; and a fourth closure bar at the sixth side and extending a full length of the sixth side, wherein the fourth closure bar is between the third partition sheet and the second partition sheet.

4. The heat exchanger of claim 1, wherein the first section is triangular with the base edge and two side edges.

5. The heat exchanger of claim 1, wherein the first section is a trapezoid that extends from the third side to the fourth side.

6. The heat exchanger of claim 1, wherein each passage of the first plurality of passages in the first layer comprises an inlet on the fifth side, and an outlet on the sixth side, and wherein each passage of the second plurality of passages in the second layer comprises an inlet on the third side and an outlet on the fourth side.

7. The heat exchanger of claim 1, wherein each passage of the first plurality of passages in the first layer comprises an inlet on the sixth side and an outlet on the fifth side, and wherein each passage of the second plurality of passages in the second layer comprises an inlet on the fourth side and an outlet on the third side.

8. A heat exchanger comprising:

a first side of the heat exchanger opposite a second side of the heat exchanger;

a third side of the heat exchanger extending from the first side of the heat exchanger to the second side of the heat exchanger, and extending in a lengthwise dimension;

a fourth side of the heat exchanger extending from the first side of the heat exchanger to the second side of the heat exchanger, and extending in the lengthwise dimension, wherein the fourth side of the heat exchanger is longer in the lengthwise dimension than the third side of the heat exchanger;

a fifth side of the heat exchanger extending from the first side of the heat exchanger to the second side of the heat exchanger, wherein the fifth side of the heat exchanger extends from the third side of the heat exchanger to the fourth side of the heat exchanger;

a sixth side of the heat exchanger extending from the first side of the heat exchanger to the second side of the heat exchanger, wherein the sixth side of the heat exchanger extends from the third side of the heat exchanger to the fourth side of the heat exchanger, wherein the fourth side of the heat exchanger extends in the lengthwise dimension parallel to the third side of the heat exchanger from the fifth side to the sixth side;

a first layer comprising:

a first plurality of passages, wherein each passage of the first plurality of passages extends from the fifth side of the heat exchanger to the sixth side of the heat exchanger; and a second layer comprising:

a second plurality of passages, wherein each passage of the second plurality of passages extends from the third side of the heat exchanger to the fourth side of the heat exchanger;

a first second, wherein the second plurality of passages extend in a first direction in the first section;

a second section adjacent to the first section, wherein the second section comprises three edges that form a triangle, wherein one of the three edges of the second section is at the fourth side of the heat exchanger and another of the three edges of the second section is at the sixth side, wherein the second plurality of passages extends in a second direction in the second section, and wherein the first direction is angled relative to the second direction, and wherein the second plurality of passages in the second section of the second layer is parallel to the sixth side, and the second plurality of passages in the first section are orthogonal to the third side.

9. The heat exchanger of claim 8, wherein the first section comprises a first plurality of fins extending in the first section, and the second section comprises a second plurality of fins extending in the second direction, and wherein the first plurality of fins and the second plurality of fins form the second plurality of passages.

10. The heat exchanger of claim 8, further comprising:

a first partition sheet, wherein the first partition sheet forms a top of the first layer;

a second partition sheet, wherein the second partition forms a bottom of the second layer;

a third partition sheet, wherein the third partition sheet is between the first layer and the second layer;

a first closure bar at the third side and extending a full length of the third side, wherein the first closure bar is between the first partition sheet and the third partition sheet;

a second closure bar at the fourth side and extending a full length of the fourth side, wherein the second closure bar is between the first partition sheet and the third partition sheet;

a third closure bar at the fifth side and extending a full length of the fifth side, wherein the third closure bar is between the third partition sheet and the second partition sheet; and a fourth closure bar at the sixth side and extending a full length of the sixth side, wherein the fourth closure bar is between the third partition sheet and the second partition sheet, wherein the first plurality of fins and the second plurality of fins are between the third partition sheet and the second partition sheet.

11. The heat exchanger of claim 8, wherein the first section is a trapezoid that extends from the third side to the fourth side and comprises a base edge disposed on the third side and extending an entire length of the third side.

12. The heat exchanger of claim 8, wherein the first section is triangular with a base edge and two side edges, wherein the base edge of the first section is on the third side and extends along an entire length of the third side.

13. The heat exchanger of claim 8, wherein the first layer comprises an inlet on the fifth side, and an outlet on the sixth side, and wherein the second layer comprises an inlet on the third side and an outlet on the fourth side.

14. The heat exchanger of claim 8, wherein the first layer comprises an inlet on the fifth side, and an outlet on the sixth side, and wherein the second layer comprises an inlet on the fourth side and an outlet on the third side.

15. The heat exchanger of claim 8, wherein the second plurality of passages in the second section of the second layer is parallel to the sixth side, and the second plurality of passages in the first section are orthogonal to the third side and the fourth side.

* * * * *